US005476061A

United States Patent [19]

Ackerbloom

[11] Patent Number: 5,476,061

[45] **Date of Patent: * Dec. 19, 1995**

[54] POWER BOAT HULL

[76] Inventor: T. Robert Ackerbloom, 4751 Rosewood Dr., Orlando, Fla. 32806

[ * ] Notice: The portion of the term of this patent subsequent to Oct. 4, 2011, has been disclaimed.

[21] Appl. No.: 316,799

[22] Filed: Oct. 3, 1994

Related U.S. Application Data

[63] Continuation of Ser. No. 100,030, Jul. 30, 1993, Pat. No. 5,351,642, which is a continuation-in-part of Ser. No. 765, 168, Sep. 25, 1991, Pat. No. 5,231,945.

[51] Int. Cl.[6] ..... B63B 1/32

[52] U.S. Cl. ..... 114/290; 114/291

[58] Field of Search ..... 114/56, 57, 274, 114/288, 289, 290, 291

[56] References Cited

U.S. PATENT DOCUMENTS

| | | | |
|---|---|---|---|
| 1,559,660 | 11/1925 | Ward | 114/57 |
| 3,117,544 | 1/1964 | Schoell | 114/56 |
| 3,216,389 | 11/1965 | Thorsen | 114/56 |
| 3,515,087 | 6/1970 | Stuart | 114/57 |
| 4,465,009 | 8/1984 | Wood et al. | 114/56 |
| 4,584,959 | 4/1986 | Allison | 114/291 |
| 4,672,905 | 6/1987 | Pipkorn | 114/56 |
| 4,723,928 | 2/1988 | Riley | 114/56 |
| 4,813,365 | 3/1989 | Lindstrom et al. | 114/56 |
| 5,231,945 | 8/1993 | Ackerbloom | 114/291 |
| 5,351,642 | 10/1994 | Ackerbloom | 114/291 |

*Primary Examiner*—Stephen Avila

*Attorney, Agent, or Firm*—Allen, Dyer, Doppelt, Franjola & Milbrath

[57] ABSTRACT

A power boat hull has an inner running surface with a central running surface and an outer running surface that flanks the inner running surface. The outer running surface forms a channel with concave curvature which extends from the bow to the stern. An improved channel is shaped so that pressure builds in the channel during turning of the boat to lock the hull to water throughout the turn. A transom is provided with a deflector plate having a curved surface that is lifted out of the water during high speed running of the boat and operatively deflects water downward to force the bow of the boat into the water during low speed running of the boat. The transom dimensions are altered to accommodate varying length boats.

15 Claims, 3 Drawing Sheets

POWER BOAT HULL

This is a continuation of application Ser. No. 08/100,030 filed on Jul. 30, 1993, which will issue on Oct. 4, 1994 as U.S. Pat. No. 5,351,642. Such application (08/100,030) is a Continuation-In-Part application from a related application Ser. No. 07/765,168 filed on Sep. 25, 1991 and issuing as U.S. Pat. No. 5,231,945 on Aug. 3, 1993.

BACKGROUND OF THE INVENTION

1. Field of Invention

This invention relates to boat hulls used on power boats to lock the hull to the water during different maneuvers of the boat. And more particularly, this invention relates to techniques for locking the boat to the water during turning or boat performance at various boat speeds and the elements that effect such boat performance for varying boat lengths.

2. Description of Related Art

Deep V-shape hulls are commonly known in boat construction technique. Examples of V-shape boat designs are disclosed in U.S. Pat. No. 3,117,544 issued to H. L. Schoell on Jan. 14, 1964, U.S. Pat. Nos. 4,233,920 issued to Forrest L Wood et al. on Nov. 18, 1980, and 4,465,009 issued on Aug. 14, 1984. Typical deep V-shape constructions include a center running surface flanked outward with a plurality of chines to form intermediate and outer running surfaces. A properly constructed V-shape bottom boat cuts through the water, displacing it on each side of the hull. Deep V-shape constructions are adequate for cutting through waves in water. However, due to the relatively large V-shape hull area, a great amount of drag is exerted at lower speeds. Further, V-shape hull constructed boats require that the center of gravity of the boat be well aft of amidships for high speed planing. Thus, the V-shape hull has a tendency to operate with the bow up at low speeds.

At any speed when the V-shape hull boat is turned, the boat hull lays over to one side. As the boat lays over, it has a tendency to skip on the water creating an uncontrolled turn. The harder the boat is turned, the greater the uncontrollability of the turn.

Another drawback of V-shape hull or bottom boats is that they develop spray when the boat hull displaces water. This spray often splashes up the side of the boat onto passengers.

One common V-shape hull design exhibits a deep sharp V-shape at the bow of the boat along with a variety of contours at the transom to provide stern lift at slow speeds. This hull design creates a large surface area that contacts the water when the boat is turned. An inherent problem with this large surface area is that the water surface on which the boat turns does not always remain constant. Consequently, when a boat with a lifting structure at its stern is turned in choppy water, the water may hook the bow resulting in a dip or a spin.

To assist in turning maneuvers, V-shape hull designs reduce the degree of V-shape angle at the transom. However, the reduced degree of angle at the transom increases water impact on rough water causing a harder, less than comfortable ride.

SUMMARY OF THE INVENTION

A V-shaped boat hull is provided with an inner running surface and an outer running surface that forms a channel having in cross-section a concave curvature that extends from the bow of the hull to the extreme aft. This deep concave channel captures displaced water and directs it to the rear of the boat where the after portion of the channel turns down the water to lift the rear of the boat. This downturning occurs only during takeoff and at moderate boat running speeds. At high speeds, the channel is lifted out of the water so that water passes along the boat with no adverse affect on the softness of the ride.

However, at any speed when the boat is turned, the hull lays over on one side where the channel again becomes effective. The water trapped under the hull is channeled aftward. Preferably, the concave curvature is angled down at the rear of the hull and the depth of the concave curvature gradually decreases from amidships to the stern. The pressure created at the rear of the channel pushes the forward section of the channel down even harder thereby increasing the effectiveness of the channel. Thus, the harder the boat is turned, the harder the channel works to create a smooth, positive controlled turn.

The bow section of the hull flares inwardly and is concave, gradually running into mid and rear sections of the concave channel. By maintaining a substantial concave curvature under the bow of the boat, an added benefit is created of keeping spray under the bow and preventing passengers from getting wet. Also, by extending a concave curved channel to the extreme bow, the channel captures air under the hull when the boat runs at high speeds generating lift. This air trapped in the channel under the hull adds stability to the boat's ride when the boat runs through choppy water. Adding a bumpy surface to the channel increases air pressure or resistance by disturbing air flow through the channel and provides increased stability.

What makes the channel so effective is that as more pressure is created at one end of the channel, pressure is increased at the opposite end. Control is maintained due to the area of water being used for controlling the turning of the boat is reduced to a relatively small uniform common area under the boat.

Bow up during takeoff is prevented on the hull with a recessed transom that is located behind a central running surface. The transom has a deflector plate molded into its bottom. The deflector plate forms a step with a central running surface. The plate lifts above the water when the boat hull travels at high speed. The curvature of the deflector plate achieves its maximum depth at its midpoint and then decreases from mid-transom to the stern. Water is channeled directly against the angled deflector plate by the walls on each side of the recessed concave area. The water flowing into the concave area must exit by passing under the angled deflector plate, the increased pressure and the greater angle of attack of the plate create a much greater amount of lift at the transom than a flat transom extension running parallel to the bottom of the hull. This deflection angle helps force the bow of the boat into the water when the boat travels at low speeds.

The effectiveness of the outer concave channels increases as the overall length of the boat increases. Therefore the relative depth needs to be reduced to improve on the riding comfort of longer boats. In addition to channel shape, the transom dimensions including transom angle is modified to provide this added comfort for boats of varying sizes. It is therefore an object of the invention to improve the comfort and handling of V-shape boat hulls. It is also an object of the invention to provide such improvements for boats of varying length where it has not been obvious to make certain dimensional changes to the hull and transom as the overall boat length changes.

BRIEF DESCRIPTION OF THE DRAWINGS

The foregoing and other objects, features and advantages of the invention will become more apparent by reference to the accompanying drawings and the following detailed description taken in conjunction with the drawings in which.

DETAILED DESCRIPTION OF THE PREFERRED EMBODIMENTS

Figure 1:
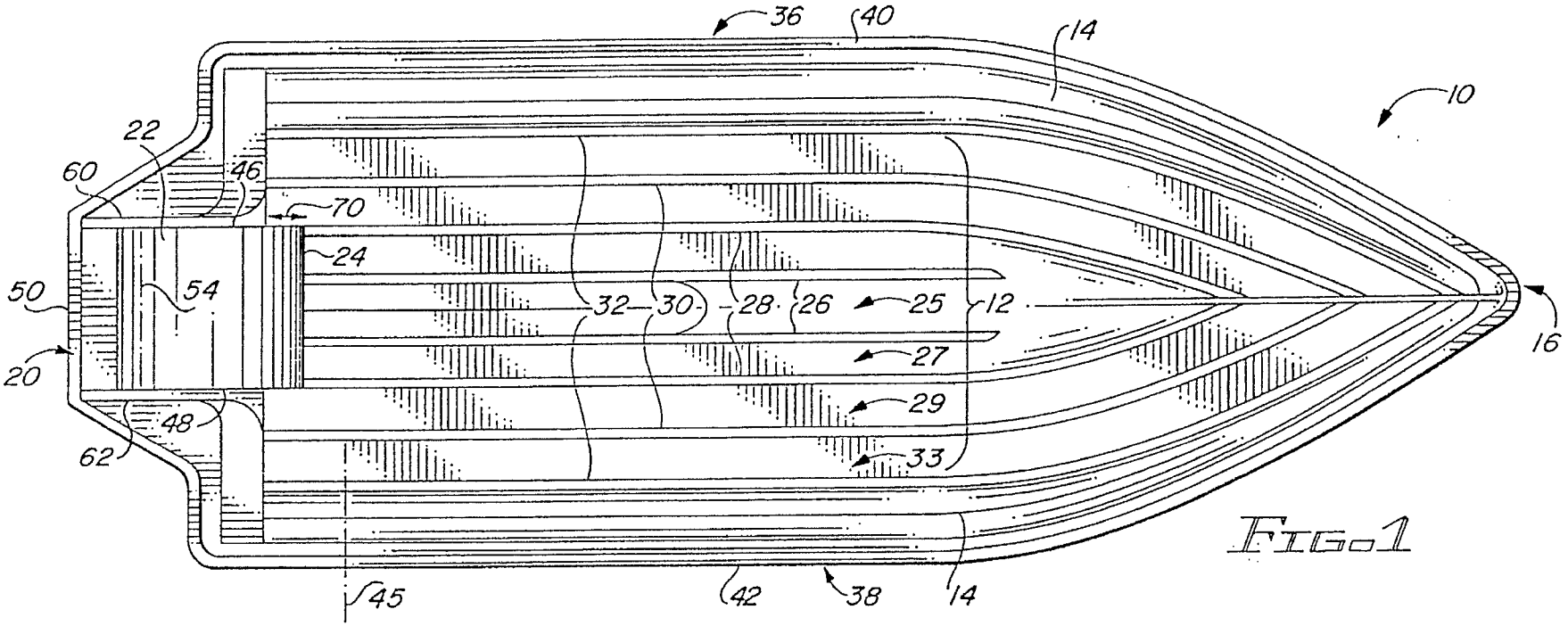
FIG. 1 is a bottom view of the boat hull from bow to stern illustrating the relationship of the inner running surface to the central and out running surfaces, and the transom.

Referring to FIGS. 1–4 there is shown a deep V-shape entry hull 10 for use on a power boat. The hull 10 has an inner running surface 12 extending from the bow of the boat to the stern 18, and an outer running surface 14 extending from the extremity of bow 16 of the hull 10 to the stern 18. Referring to FIGS. 1–2 and 4–6, disposed on the stern 18 of boat hull 10 is transom 20 having a deflector plate 22 with concave curvature. Plate 22 is recessed to form a step 24 with respect to inner running surface 12.

Referring to FIGS. 1–4, extending from fore to aft on hull 10 within inner running surface 12 are chine pairs 26, 28, 30 and 32. Chine pairs 26 extend from step 24 along transom 20 to a point forward of amidships. Chine pair 26 form a central running surface 25 there between. Chine pairs 26 and 28, 28 and 30, and 30 and 32, form a first intermediate running surface 27, a second intermediate running surface 29 and a third intermediate running surface 33, respectively. Disposed along the perimeter of starboard and port side of entry hull 10 are side walls 36 and 38 respectively, which extend downward to form lips 40 and 42 respectively, on the bottom of hull 10.

Again with reference to FIGS. 1 and 2, inner running surface 12 extends fore and aft of the hull, the cross-section of which transitions from a pronounced V-shape to a moderate V-shape aft amidships. In addition, each of the intermediate running surfaces 27, 29 and 33 successively flank the central running surface 25 and extend fore and aft the central running surface 25 while transitioning from a pronounced V-shape to a substantially planar configuration. Flanking the third intermediate surface 33 is outer running surface 14. Outer running surface 14 forms a channel 44 having a cross-section of concave curvature (see FIG. 7) commencing at the extreme bow end of hull 10 and extending to the extreme aft end or stern 18 of hull 10.

Figure 8:
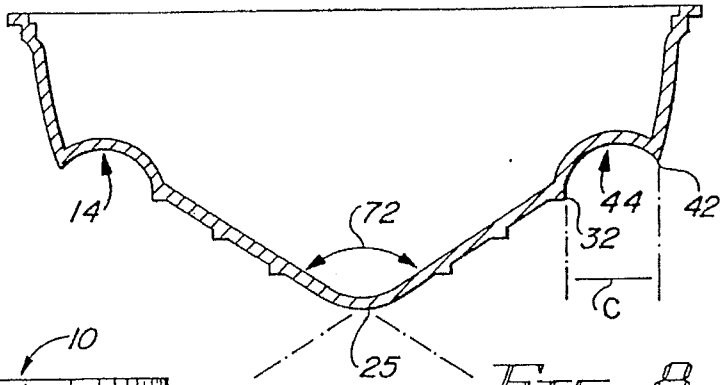
FIG. 8 is a partial cross-sectional view of the hull amidships further illustrating the V-shape of the inner running surface and the general concave shape of the channel.
Figure 4:
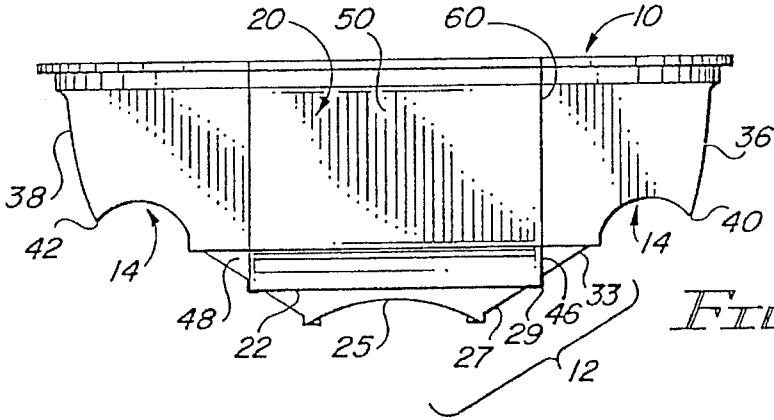
FIG. 4 is a rear view of the boat hull shown in FIG. 1 illustrating the generally planar configuration of the central running surface at the stern as well as the channel shape at the stern.
Figure 3:
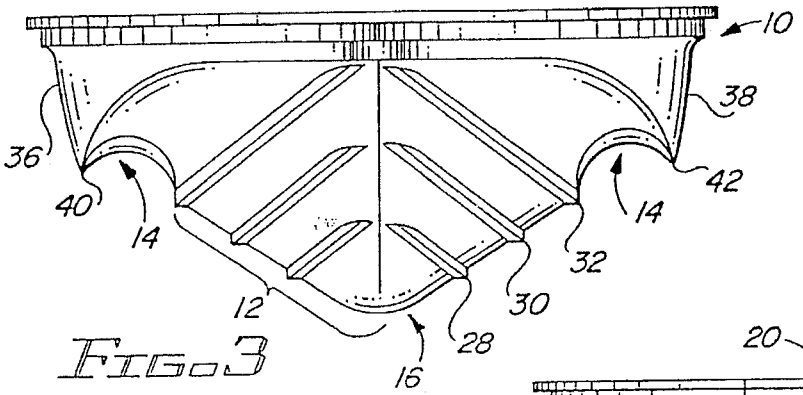
FIG. 3 is a front view of the boat hull shown in FIG. 1 illustrating the concave channels of the outer running surface and the generally V-shape of the forward portion of the hull.
Figure 7:
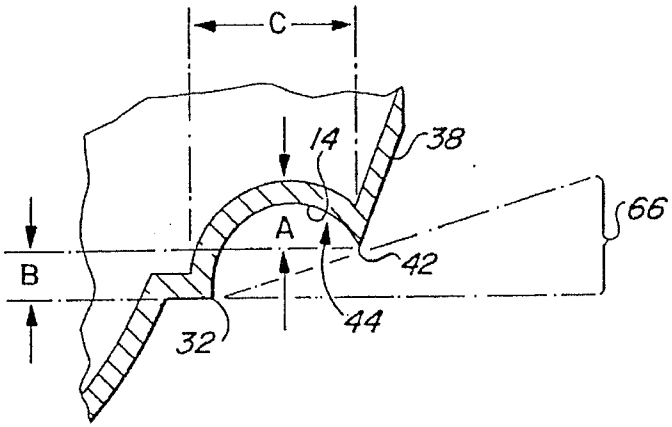
FIG. 7 is a section view of the outer channel of the boat hull along line 7—7 of FIG. 1 illustrating the channel parameters useful in defining the channel at various locations along the hull.

Referring to FIG. 7 there is shown channel 44 at an amidships point of hull 10. FIG. 8 is a partial cross-sectional view of the hull amidships further illustrating the V-shape of the inner running surface in relation to the general concave shape of the channel. The following Table 1 discloses preferred dimensions for the arc curvature, depth and chine 32 height of this outer running surface 14 at different locations of the outer running surface 14 with respect to bow 16. The Table 1 data are presented by way of example for boats with overall lengths of eighteen feet-three inches, nineteen feet-three inches, twenty feet-six inches, and twenty feet-nine inches.

Again with reference to FIG. 7 and Table 1, dimension "A" represents a first vertical dimension between an apex of curvature to a first imaginary horizontal line passing through the outside lip 42. Dimension "B" represents a second vertical dimension between the first horizontal line and a second imaginary horizontal line passing through the inside chine 32. Dimension "C" represents the horizontal distance between the chine 32 and the lip 42. It is appreciated that one skilled in the art could devise alternate descriptions for the channel. The description presented is intended to provide one clear definitive way of describing such a channel. With measurements starting at the stern, the channel dimension "A" increases in all boats presented from the stern to a point approximately amidships at which time it begins to reduce toward the bow. It is noted that as the overall length of a boat increases the point amidships where "A" reaches a maximum gradually moves aft. In other words the maximum "A" is at a predetermined distance from the stern (96" in the example shown) and then decreases from that point toward the bow for each boat. Dimension "B" gradually increases to another point approximately amidships forward of the maximum "A" dimension. Dimension "C" gradually increases from stern to bow. Dimension "C" is one description of the width of the outside running surface 14. There is a wide range of effective widths for a smooth functioning performance of a boat and boat riding comfort. The factors that go into determining such performance and comfort include the outer running surface as well as the boat width and angle 72 of the V-shape. It should be noted that as the V-shape angle 72 decreases, the outer running surface width increases or dimension "C" increases to achieve improved performance. The precise width of the outer running surface is not absolute and is provided here for example and for the dimensions used in the preferred embodiment. Dimensional margins are permitted and in fact variations will occur based on style of boat and configuration of hull.

TABLE 1

CHANNEL DIMENSIONS FOR VARIOUS BOAT OVERALL LENGTHS

| Overall Length (Ft-In) | Distance From Stern (Inches) | A | B | C |
|---|---|---|---|---|
| 18-3 | 0 | .5 | .5 | 7.00 |
| | 26 | 1.5 | 1.25 | 7.00 |
| | 72 | 1.75 | 1.25 | 7.50 |

TABLE 1-continued

| CHANNEL DIMENSIONS FOR VARIOUS BOAT OVERALL LENGTHS | | | | |
|---|---|---|---|---|
| Overall Length (Ft-In) | Distance From Stern (Inches) | A | B | C |
| | 96 | 1.75 | 1.50 | 8.00 |
| | 120 | 1.50 | 2.00 | 8.50 |
| 19-3 | 0 | .75 | 1.00 | 7.25 |
| | 26 | 1.50 | 1.75 | 7.25 |
| | 72 | 1.50 | 2.00 | 7.75 |
| | 96 | 1.50 | 2.50 | 8.50 |
| | 120 | 1.25 | 3.00 | 9.50 |
| 20-6 | 0 | .75 | 1.25 | 7.25 |
| | 26 | 1.25 | 1.75 | 7.25 |
| | 72 | 1.25 | 2.25 | 7.75 |
| | 96 | 1.25 | 2.50 | 8.75 |
| | 120 | 1.00 | 3.25 | 9.25 |
| 20-9 | 0 | 1.00 | 1.50 | 7.25 |
| | 26 | 1.25 | 1.75 | 7.25 |
| | 72 | 1.00 | 2.50 | 8.00 |
| | 96 | 1.00 | 3.00 | 8.75 |
| | 120 | .50 | 3.50 | 9.75 |

In order to increase aerodynamic lift at high boat speeds, ridges (not shown) are placed across the channel 44 on the hull surface and spaced along the channel 44 from generally amidships and forward to the bow. Such ridges or bumps develop increases air pressure and hamper air flow to under the boat. The increased air pressure helps carry the weight of the boat and results in increased speed.

Figure 6:
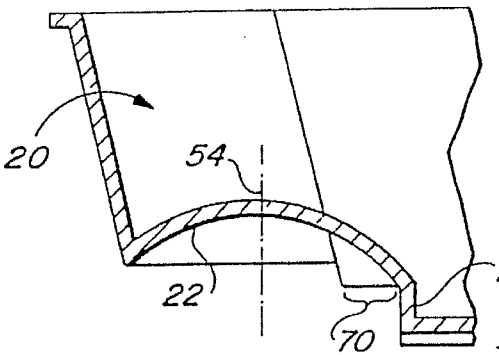
FIG. 6 is a side section view of the transom cut along line 6—6 of FIG. 1 illustrating the concave curvature of the transom deflector plate.

Referring to FIG. 6, it is preferable that the depth of concave curvature gradually decreases from location 45 to the stern at an angle of 6° designated by number 58. This angle 58 provides maximum lock down of the bow of the hull in the water during turning. On a nineteen-foot three-inch boat hull, for example, it is preferable that location 45 be positioned about twenty-six inches fore of the stern extremity of outer running surface 14. In the preferred embodiment, the surface of lip 40, shown in FIG. 7, and designated by number 66, be 7° with respect to the horizon above the surface of chine 32 and the hull when the hull 10 is resting in a horizontal upright position.

Referring again to FIGS. 1, 4 and 6, transom 20 includes deflector plate 22 bounded by transom step side walls 46 and 48. The transom has outside side walls 60 and 62. At this aft portion, deflector plate 22 is integrally formed with deflector stern wall 50. Deflector plate 22 is recessed with respect to central running surface 25 and first intermediate running surface 27. Again referring to FIGS. 1 and 2, step 24 is formed between transom 20 and central running and first intermediate running surfaces 25 and 27.

Deflector plate 22 extends from before the stern portion of hull 10 aftward away from hull 10. Deflector plate has concave curvature extending from step 24 to deflector stern wall 50. This deflector plate reaches its maximum depression point at mid-transom designated as number 54. The deflector plate then decreases its depth from mid-transom point 54 to deflector stern wall 50. When a boat hull travels at low speeds, water passes across the surface deflection plate 22. By way of example, the plate on a nineteen-feet, three-inch boat preferably has a maximum depth of 1.75 inches and a length of 17.75 inches. Plate 22 surface is preferably recessed into boat hull by 3.5 inches designated by number 70. The hydrodynamics of the curvature of plate 22 forces the bow of the boat downward at low speeds. The level of the surface of the deflector plate 22 in cross-section from side wall 46 to side wall 48 remains horizontal and is not angled upwards or downwards. When the boat hull travels at high speeds, the plate 22 rises above the level of the surface of the water so as not to create drag on the boat hull.

Figure 2:
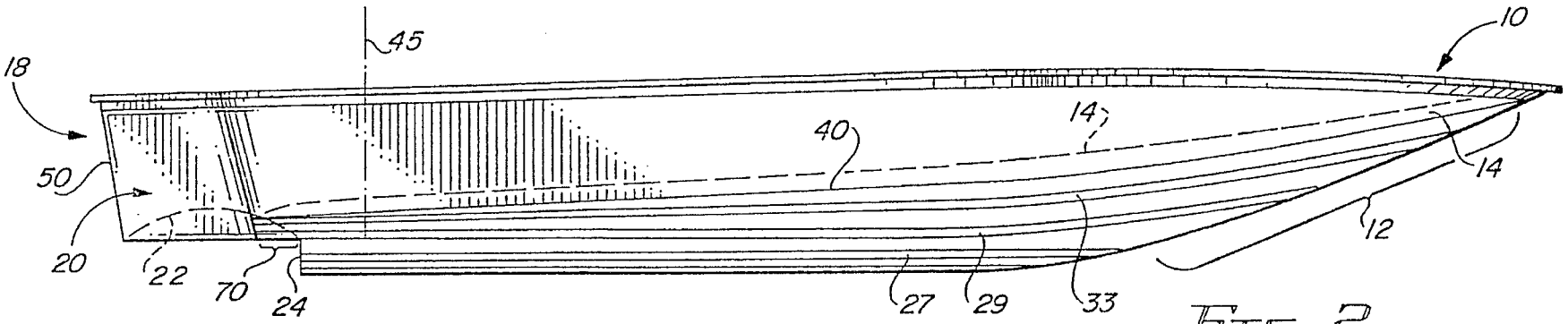
FIG. 2 is a starboard side view of the boat hull shown in FIG. 1 further illustrating the running surfaces and the transom deflector plate.
Figure 5:
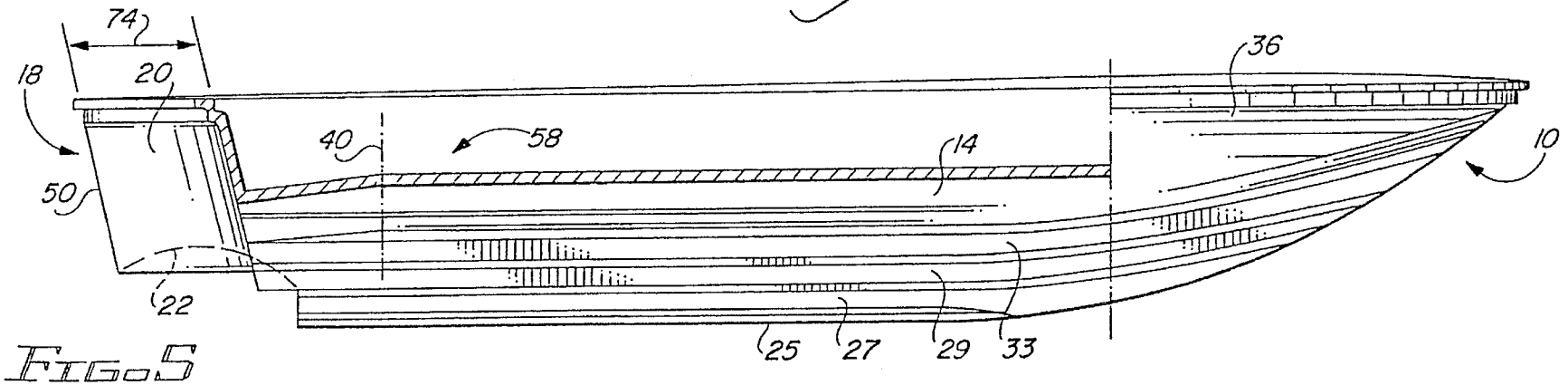
FIG. 5 is a starboard side partial section view of the boat hull outer channel sectioned along line 5—5 of FIG. 1.

Tests using varying offset transoms for varying overall length boats and varying offset distances 74 showed that the amount of offset 74 used on a nineteen foot-three inch boat was more than could be used on an eighteen foot boat. Refer to FIGS. 2 and 5. Too much bow lift was created making the boat bow light and more difficult to handle. The balance of the boat was adversely affected by setting the motor back so far. Therefore, decreasing the offset 74 when going to boats smaller than a nineteen footer was needed. When increasing overall boat lengths, for example to a twenty one footer, the offset 74 can be increased. By extending the offset 74, the added leverage gained helps to carry the added length of the boat and improve boat balance.

Figure 9:
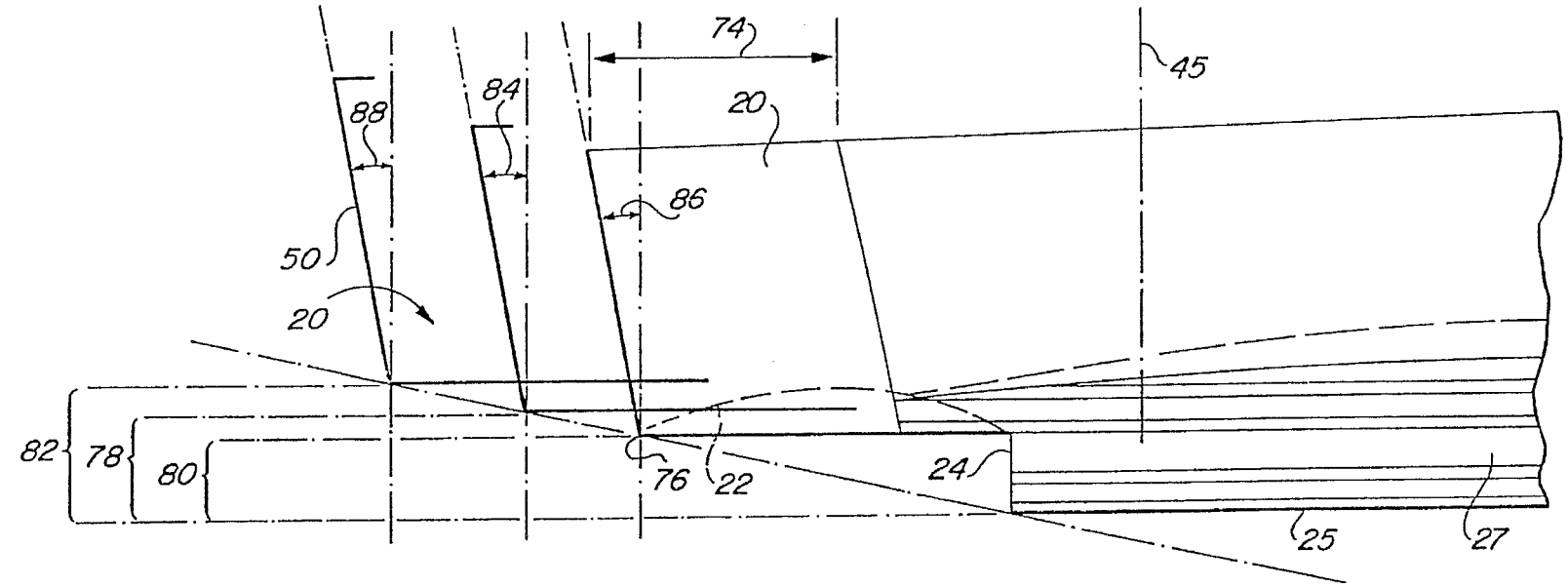
FIG. 9 is a partial view of the boat stern section illustrating the relationship of transom angle to transom height for boats of varying overall lengths.

The offset transom 20 includes other modifications when considering varying overall boat length. With reference to FIG. 9, by way of example, when a boat increases form overall lengths of eighteen feet, nineteen feet, and twenty one feet, as discussed the offset 74 increases. Additionally, the height of the transom 74 above the water must also change. One way to describe this change is to consider the height of the transom aft end lip 76 above an imaginary line extending aft from the hull central running surface 25 planar at the stern. If we use the nineteen foot-three inch boat as a norm height 78, when going to an eighteen foot-three inch overall length, the aft end lip height 80 will decrease by about three inches. If we increase the overall length to a twenty foot six inch overall length, the transom aft end lip height 82 will increase by about four inches. The heights 78, 80 and 82 must change in order to make certain that the deflector plate 22 is clear of the water at high boat speeds. Transom angle 84 will also change with varying overall length. Again with reference to FIG. 9, as the overall length of the boat increases, the transom angle 84 decreases. By way of example, the nineteen-three norm has a transom angle 84 of approximately 14, the eighteen foot-three inch boat has a transom angle 86 of approximately 15, and the twenty foot-six inch has a transom angle of approximately 11.

In reviewing some of the characteristics of the varying overall length boats realized in testing and reflected in the improved structure of the invention, the overall effectiveness in controlling the maneuverability is maintained and can increase with more forward concave inner running surface. In other words, as a boat gets longer, the depth (dimension "A") of the channel 44 has to be decreased to decrease the holding power of the concave surface as well as the height of the lip 42 above the chine 32 (dimension "B") as reflected in Table 1. In other words, the lip 42 must be made to be less effective. The relationship of the lip 42 to the chine 32 is important because water contacting the lip 42 can be deflected by the chine 32 and reduce some of the effective holding power of the lip 42. By way of example, if the channel 44 were left the same for a nineteen and a twenty one foot boat, the performance would be dramatically and adversely affected. Conversely, when one shortens the overall length of the boat, the outer concave running surface 14 has to be more aggressive because of the reduced distance from the stern to a point of turning the boat to make the channel 44 lock to the water. In other words, the depth of the curvature (dimension "A") has to be increased to increase the boat performance. The aerodynamic effects of the concave outer running surface 14 increase as boat length increases in front of the motor. The offset transom 20 and dimensional changes discussed earlier with regard to contacting the water surface equally apply to the aerodynamics. Fortunately, the channel dimensions are consistent for improving both aerodynamics and turning. An additional change when varying overall boat length includes angling down the outer running surface 14 more for shorter boats to help the shorter boat accelerate in a more level manner. The angle of attack of the outer running surface 14 has to be increased on the shorter boat and increased ion the longer boat when comparing the angle of attach (not shown) to the norm nineteen footer. The final effects of the varying overall length boats remain very similar when attention to the dimensional changes is made.

This concludes the description of the preferred embodiments. A reading by those skilled in the art will bring to mind various changes without departing from the spirit and scope of the invention. It is intended, however, that the invention only be limited by the following appended claims.

What is claimed is:

1. A power boat hull having a bow and a stern, the hull comprising:

an inner running surface extending fore and aft along the hull, the inner running surface having a generally V-shape cross-section from fore to aft;

a central running surface extending fore and aft along the hull, the central running surface an integral part of the inner running surface; and an outer running surface flanking the central running surface, the outer running surface forming a channel at least partially between the bow and the stern, wherein at take off and moderate running speeds, the channel captures displaced water and directs the displaced water toward the stern, the channel having a contour for directing the displaced water downward thereby lifting the hull from its stern portion, further at higher boat hull running speeds, where the channel is lifted above a surface of the water thereby permitting the displaced water to freely pass, a channel forward portion directing the displaced water during turning of the hull.

2. The power boat hull as recited in claim 1, wherein the channel commences at the stern and extends at least partially along the hull toward the bow.

3. The power boat hull as recited in claim 1, wherein the inner running surface comprises a V-shape cross-section generally fore to aft.

4. The power boat hull as recited in claim 1, wherein the inner running surface transitions from a deep V-shape to a modified V-shape in cross-section from fore to aft.

5. The power boat hull as recited in claim 1, wherein the central running portion comprises a V-shape cross-section generally fore to aft.

6. The power boat hull as recited in claim 1, wherein the central running portion transitions from a V-shape cross-section to a substantially planar cross-section from fore to aft.

7. A power boat hull having a bow and a stern, the hull comprising:

a running surface extending from the bow to the stern, the running surface further having a central portion extending from the bow to the stern and an outer portion flanking the central portion; and a channel within each outer portion, the channel having forward, middle and aft portions, wherein the forward portion of the channel captures displaced water and directs the water for lifting a hull forward portion, the channel forward portion directing the water toward the stern thereby limiting sideward directed water spray and thus limiting water spay from the hull forward portion, wherein the middle portion limits sideward directed water spray, and wherein the aft portion provides further lifting of the hull for generally high running speeds and further maintains sufficient contact with a water surface over which the hull is operating for providing generally level turning of the hull during the high speeds.

8. The power boat hull as recited in claim 7, wherein the running surface has at a portion of which is v-shaped.

9. The power boat hull as recited in claim 7, wherein the running surface has a generally deep V-shape proximate the bow and transitions to a generally modified V-shape proximate the stern.

10. The power boat hull as recited in claim 7 wherein the channel has a generally bowed cross-section along an imaginary plane through an axis of the channel passing from fore to aft.

11. A power boat hull having a bow and a stern, the hull comprising:

a running surface extending fore and aft along the hull for having at least a portion of the running surface in contact with water over which the hull is operating, the running surface further having a generally V-shape cross-section for at least a portion of the running surface; and a transom disposed aft of the running surface, the transom having a deflector plate with a surface of concave curvature wherein the plate surface is positioned to be substantially removed from the water during generally high boat operating speeds, the plate surface receiving water channeled against the deflector plate at low operating speeds wherein a lift is created at the transom thereby forcing the boat bow toward the water, and wherein the hull is free of a propeller or shaft within the curvature of the deflector plate.

12. The power boat hull as recited in claim 11, further comprising walls positioned on port and starboard sides of the deflector plate, the walls dimensioned for channeling water directly against the concave surface of the deflector plate causing the channeled water to exit the deflector plate by passing under the concave plate surface causing an increased pressure against the plate surface thereby creating the transom lift.

13. The power boat hull as recited in claim 11, wherein the deflector plate is recessed in the hull to exhibit a step with the running surface.

14. The power boat hull as recited in claim 11, wherein the curvature of the deflector plate achieves its maximum depth at its midpoint and decreases from mid-transom to stern.

15. The power boat hull as recited in claim 11, wherein the deflector plate is molded within the transom.

* * * * *